US010160135B2

(12) United States Patent
Bozic

(10) Patent No.: US 10,160,135 B2
(45) Date of Patent: Dec. 25, 2018

(54) POWER-TOOL PARTING DEVICE

(71) Applicant: Robert Bosch GmbH, Stuttgart (DE)

(72) Inventor: Milan Bozic, Solothurn (CH)

(73) Assignee: Robert Bosch GmbH, Stuttgart (DE)

( * ) Notice: Subject to any disclaimer, the term of this patent is extended or adjusted under 35 U.S.C. 154(b) by 176 days.

(21) Appl. No.: 14/394,299

(22) PCT Filed: Mar. 5, 2013

(86) PCT No.: PCT/EP2013/054329
§ 371 (c)(1),
(2) Date: Oct. 14, 2014

(87) PCT Pub. No.: WO2013/159970
PCT Pub. Date: Oct. 31, 2013

(65) Prior Publication Data

US 2015/0075349 A1 Mar. 19, 2015

(30) Foreign Application Priority Data

Apr. 25, 2012 (DE) ..... 10 2012 206 787

(51) Int. Cl.
*B27B 33/14* (2006.01)

(52) U.S. Cl.
CPC ..... *B27B 33/142* (2013.01); *B27B 33/14* (2013.01); *B27B 33/145* (2013.01); *Y10T 83/909* (2015.04)

(58) Field of Classification Search
CPC ..... B27B 33/14; B27B 33/142; Y10T 83/909
See application file for complete search history.

(56) References Cited

U.S. PATENT DOCUMENTS 1,372,903 A * 3/1921 Perkins ..... B23D 55/088 408/11
2,347,765 A * 5/1944 Boice ..... B23D 55/02 83/818
2,351,738 A * 6/1944 Blum ..... B23D 63/02 83/832
2,755,828 A * 7/1956 Dunnington ..... B27B 33/142 83/833
3,228,437 A * 1/1966 Wezel ..... A22B 5/206 83/830
3,298,406 A 1/1967 Erickson
3,340,911 A * 9/1967 Wolf ..... B27B 33/142 83/832
3,346,025 A * 10/1967 Anderson ..... B27B 33/14 83/833

(Continued)

FOREIGN PATENT DOCUMENTS

CN 85 2 01692 U 6/1986
CN 836 1 08132 A 6/1988

(Continued)

OTHER PUBLICATIONS

International Search Report corresponding to PCT Application No. PCT/EP2013/054329, dated May 23, 2013 (German and English language document) (5 pages).

*Primary Examiner* — Stephen Choi
(74) *Attorney, Agent, or Firm* — Maginot, Moore & Beck LLP

(57) ABSTRACT

A machine tool separating device has at least one cutting line. The cutting line has a changing cutting edge angle geometry along one cutting direction of the cutting line.

14 Claims, 4 Drawing Sheets

(56) References Cited

U.S. PATENT DOCUMENTS

| | | | | |
|---|---|---|---|---|
| 3,910,147 | A | 10/1975 | Heyerdahl | |
| 4,218,820 | A | 8/1980 | Cleva | |
| 4,518,022 | A | 5/1985 | Valdes et al. | |
| 4,807,366 | A * | 2/1989 | Masato | B27B 17/0008 30/381 |
| 5,257,568 | A | 11/1993 | Nitschmann | |
| 5,772,957 | A | 6/1998 | Thomson et al. | |
| 6,408,730 | B1 * | 6/2002 | Tinner | B27B 33/142 30/376 |
| 2014/0123827 | A1 * | 5/2014 | Fuchs | C04B 35/638 83/830 |

FOREIGN PATENT DOCUMENTS

| | | | |
|---|---|---|---|
| CN | 2059861 | U | 8/1990 |
| CN | 1129624 | A | 8/1996 |
| DE | 36 40 857 | A1 | 6/1988 |
| GB | 1091557 | | 11/1967 |
| JP | 52-36384 | | 3/1977 |
| JP | 6-206119 | A | 7/1994 |
| SU | 253342 | A1 | 12/1969 |
| SU | 296309 | A1 | 12/1971 |
| SU | 1629182 | A1 | 2/1991 |
| WO | WO-2011038844 | A1 * | 4/2011 |

* cited by examiner

POWER-TOOL PARTING DEVICE

This application is a 35 U.S.C. § 371 National Stage Application of PCT/EP2013/054329, filed on Mar. 5, 2013, which claims the benefit of priority to Serial No. DE 10 2012 206 787.6, filed on Apr. 25, 2012 in Germany, the disclosures of which are incorporated herein by reference in their entirety.

BACKGROUND

There are already known power-tool parting devices that have a cutting strand.

SUMMARY

The disclosure is based on a power-tool parting device, having at least one cutting strand.

It is proposed that the cutting strand have a cutting-edge angle geometry that varies along a cutting direction of the cutting strand. A "cutting strand" is to be understood here to mean, in particular, a unit provided to locally undo an atomic coherence of a workpiece on which work is to be performed, in particular by means of a mechanical parting-off and/or by means of a mechanical removal of material particles of the workpiece, wherein the unit comprises cutting strand segments that are mounted so as to be movable relative to each other. Preferably, the cutting strand is provided to separate the workpiece into at least two parts that are physically separate from each other, and/or to part off and/or remove, at least partially, material particles of the workpiece, starting from a surface of the workpiece. Preferably the cutting strand is realized as a cutting chain. The cutting strand in this case may be realized as a cutting chain having one, two or three link plates. Particularly preferably, in at least one operating state, the cutting strand is moved in a revolving manner, in particular along a circumference of a guide unit of the power-tool parting device. The power-tool parting device thus preferably comprises at least one guide unit for guiding the cutting strand. The expression "guide unit" is intended here to define, in particular, a unit provided to exert a constraining force upon the cutting strand, at least along a direction perpendicular to the cutting direction of the cutting strand, in order to define a possibility for movement of the cutting strand along the cutting direction. Preferably, the guide unit has at least one guide element, in particular a guide groove, by which the cutting strand is guided. Preferably, the cutting strand, as viewed in a cutting plane, is guided by the guide unit along an entire circumference of the guide unit, by means of the guide element, in particular the guide groove.

A "cutting direction" is to be understood here to mean, in particular, a direction along which the cutting strand is moved, in at least one operating state, as a result of a driving force and/or a driving torque, in particular in the guide unit, for the purpose of producing a cutting clearance and/or parting-off and/or removing material particles of a workpiece on which work is to be performed. Preferably, the cutting strand, when in an operating state, is moved, relative to the guide unit, along the cutting direction. The cutting strand and the guide unit preferably together constitute a closed system. The term "closed system" is intended here to define, in particular, a system comprising at least two components that, by means of combined action, when the system has been demounted from a system such as, for example, a power tool, that is of a higher order than the system, maintain a functionality and/or are inseparably connected to each other when in the demounted state. Preferably, the at least two components of the closed system are connected to each other so as to be at least substantially inseparable by an operator. "At least substantially inseparable" is to be understood here to mean, in particular, a connection of at least two components that can be separated from each other only with the aid of parting tools such as, for example, a saw, in particular a mechanical saw, etc. and/or chemical parting means such as, for example, solvents, etc.

A "cutting-edge angle geometry" is to be understood here to mean, in particular, an angle geometry of a cutting edge of a cutting element of the cutting strand, such as, for example, a magnitude of a rake angle and/or a magnitude of a clearance angle that geometrically defines the cutting edge. The cutting strand, in particular along the cutting direction, thus has a cutting-edge angle geometry that varies from one cutting strand segment to another or within a cutting strand segment of the cutting strand. Advantageously, the configuration of the power-tool parting device according to the disclosure makes it possible to achieve a high cutting rate in various types of materials of workpieces on which work is to be performed. Thus, advantageously, a wide spectrum of applications can be achieved. In this case, advantageously, the power-tool parting device according to the disclosure may be used for performing work on a variety of workpieces of differing materials such as, for example, wood, metal, etc.

Furthermore, it is proposed that the cutting strand comprise at least one cutting strand segment, comprising at least one cutting element, which has at least one clearance angle realized so as to differ from a clearance angle of a cutting element of a further cutting strand segment of the cutting strand. The term "clearance angle" is intended here to define, in particular, an angle that, as viewed in the cutting plane, is enclosed by a cutting edge of the cutting element of the cutting strand and by a workpiece surface of the workpiece on which work is to be performed by means of the cutting edge, while work is being performed on a workpiece, with chip removal by means of the cutting strand. Thus, advantageously, the cutting strand can be adapted to various types of material of workpieces on which work is to be performed. For example, a large clearance angle of the cutting element of the cutting strand segment may advantageously be selected for performing work on wood and/or on plastic, and a small clearance angle of the cutting element of the further cutting strand segment may advantageously be selected for performing work on metal. An operator can thus advantageously use the cutting strand for performing work on workpieces made of a hard, short-chipping material and, at the same time, for performing work on workpieces made of a soft, plastically deformable material. Advantageously, a high degree of operating comfort can be achieved, thereby providing for an advantageous saving of time.

Further, it is proposed that the cutting strand comprise at least one cutting strand segment, comprising at least one cutting element, which has at least one rake angle realized so as to differ from a rake angle of a cutting element of a further cutting strand segment of the cutting strand.

A "rake angle" is to be understood here to mean, in particular, an angle enclosed by a at least substantially perpendicular to a workpiece surface of a workpiece on which work is to be performed and by a clamping face of a cutting element of the cutting strand. The clamping face is preferably constituted by a face that directly adjoins a cutting edge of the cutting element of the cutting strand. Preferably, the rake angle is disposed on a side of the cutting element of the cutting strand that faces away from the clearance angle. Advantageously, the configuration according to the disclosure enables chip spaces of the cutting strand to be configured in various ways. Advantageously, this enables the cutting strand to be used for a variety of workpieces, made of differing materials.

It is additionally proposed that the cutting strand comprise at least one cutting strand segment, comprising at least one cutting element and comprising at least one further cutting element, wherein the cutting element has a clearance angle realized so as to differ from a clearance angle of the further cutting element. The cutting element and the further cutting element in this case may be fixed to a cutter carrier element of the cutting strand segment by means of various types of connection, considered appropriate by persons skilled in the art, such as, for example, by means of a form-fitting, force-fitting and/or adhesive type of connection. Preferably, the cutting element and the further cutting element are realized so as to be integral with a cutter carrier element of the cutting strand element. "Integral with" is to be understood to mean, in particular, connected at least by adhesive force, for example by a welding process, an adhesive bonding process, an injection process and/or another process considered appropriate by persons skilled in the art, and/or, advantageously, formed in one piece such as, for example, by being produced from a casting and/or by being produced in a single or multi-component injection process and, advantageously, from a single blank. Preferably, the cutting element, the further cutting element and the cutter carrier element of the cutting strand segment are punched from a single blank. The configuration according to the disclosure makes it possible, advantageously, for the cutting strand to have a high removal rate. Owing to the integral configuration of the cutting element and the cutter carrier element, savings can be made, advantageously, in assembly work and costs. Particularly preferably, the further cutting element is likewise realized so as to be integral with the cutter carrier element. Thus, advantageously, a robust cutting strand segment can be achieved.

Advantageously, the cutting element of the cutting strand segment has a rake angle realized so as to differ from a rake angle of the further cutting element. Thus, advantageously, chip spaces can be configured in various ways within the cutting strand segment. It is thus advantageously possible to achieve a cutting strand segment that can be used universally for various types of material.

Furthermore, it is proposed that the cutting strand comprise at least one cutting strand segment, which has at least one cutter carrier element and at least one cutting element that together have a maximum volume that is less than 15 $mm^3$. Preferably, all cutting strand segments of the cutting strand have a volume that is less than 15 $mm^3$. Preferably, the cutting strand has a maximum volume that is less than 10 $mm^3$, and particularly preferably less than 5 $mm^3$. Advantageously inexpensive production of the cutting strand segment can be realized, requiring less material to be used.

It is additionally proposed that the cutting strand comprise at least one cutting strand segment, which has at least one cutter carrier element and at least one cutting element that together have a maximum weight that is less than 1 g. Preferably, all cutting strand segments of the cutting strand have a weight that is less than 1 g. The cutting strand segment has, in particular, a maximum weight that is less than 0.8 g, preferably less than 0.5 g, and particularly preferably less than 0.2 g. Advantageously, a light structure of the cutting strand segment can be achieved.

Further, the disclosure is based on a cutting strand segment of a cutting strand of a power-tool parting device according to the disclosure. A "cutting strand segment" is to be understood here to mean, in particular, a segment of a cutting strand provided to be connected to further segments of the cutting strand for the purpose of constituting the cutting strand. Preferably, the cutting strand segment is realized as a chain link, which is connected to further cutting strand segments, realized as chain links, for the purpose of constituting the cutting strand, preferably realized as a cutting chain. The cutting strand segment in this case may be realized as a driving member, as a connecting member, as a cutting member, etc. of a cutting chain. Preferably, the cutting strand segment comprises at least one cutter carrier element and at least one cutting element. Advantageously, an already existing cutting strand may be supplemented with a cutting strand segment according to the disclosure.

Furthermore, the disclosure is based on a power tool having at least one coupling device for coupling in a form-fitting and/or force-fitting manner to a power-tool parting device according to the disclosure. The power tool is preferably realized as a portable power tool. A "portable power tool" is to be understood here to mean, in particular, a power tool, in particular a hand-held power tool, that can be transported by an operator without the use of a transport machine. The portable power tool has, in particular, a mass of less than 40 kg, preferably less than 10 kg, and particularly preferably less than 5 kg. Preferably, the power tool and the power-tool parting device together constitute a power tool system. Advantageously, by means of the configuration of the power tool according to the disclosure, it is possible to achieve a power tool that, particularly advantageously, is suitable for a broad spectrum of applications.

The power-tool parting device according to the disclosure, the cutting strand segment according to the disclosure, the power tool according to the disclosure and/or the power tool system according to the disclosure are/is not intended in this case to be limited to the application and embodiment described above. In particular, power-tool parting device according to the disclosure, the cutting strand segment according to the disclosure, the power tool according to the disclosure and/or the power tool system according to the disclosure may have individual elements, components and units that differ in number from a number stated herein, in order to fulfill a principle of function described herein.

BRIEF DESCRIPTION OF THE DRAWINGS

Further advantages are given by the following description of the drawing. The drawing shows exemplary embodiments of the disclosure. The drawing and the description contain numerous features in combination. Persons skilled in the art will also expediently consider the features individually and combine them to create appropriate further combinations.

In the drawings.

DETAILED DESCRIPTION

Figure 1:
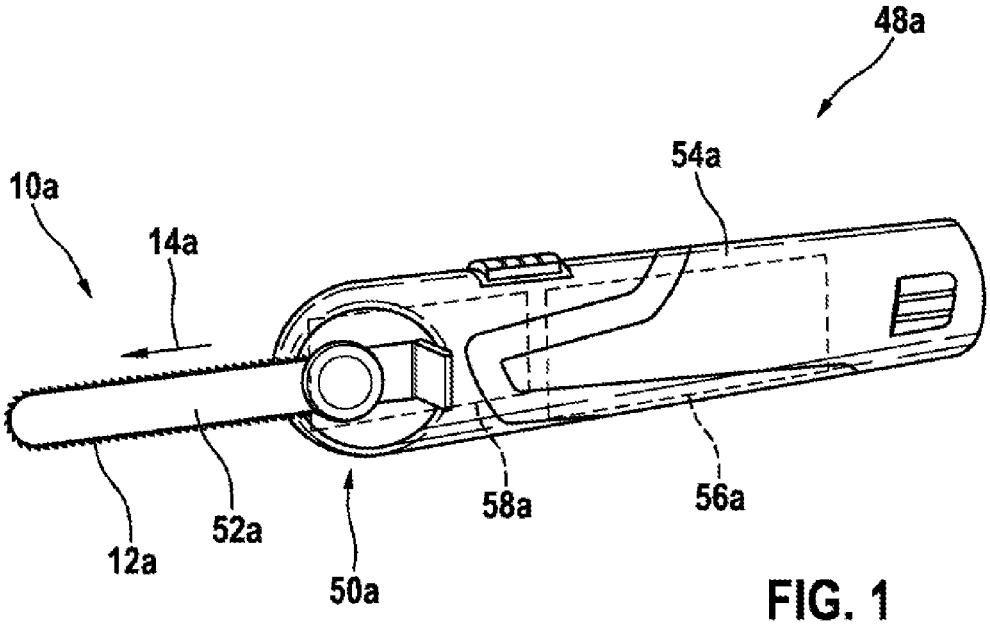
FIG. 1 shows a power tool according to the disclosure and a power-tool parting device according to the disclosure, which together constitute a power tool system according to the disclosure, in a schematic representation.

FIG. 1 shows a power tool system, which comprises a power tool 48*a* and a power-tool parting device 10*a*. The power tool 48*a* in this case is realized as a portable power tool. The power-tool parting device 10*a* comprises at least one cutting strand 12*a*, which has at least one cutting strand segment 16*a*, 34*a*, and at least one guide unit 52*a* for guiding the cutting strand 12*a*, wherein the guide unit 52*a* and the cutting strand 12*a* together constitute a closed system. The power tool 48*a* has at least one coupling device 50*a*, for coupling to the power-tool parting device 10*a* in a form-fitting and/or force-fitting manner. The coupling device 50*a* in this case may be realized as a bayonet closure and/or as another coupling device, considered appropriate by persons skilled in the art. The power tool 48*a* additionally has a power tool housing 54*a*, which comprises a drive unit 56*a* and a transmission unit 58*a* of the power tool 48*a*. The drive unit 56*a* and the transmission unit 58*a* are operatively coupled to each other to generate a driving torque that can be transmitted to the power-tool parting device 10*a*, in a manner already known to persons skilled in the art. The transmission unit 58*a* is realized as a bevel gear transmission. The drive unit 56*a* is realized as an electric motor unit. It is also conceivable, however, for the drive unit 56*a* and/or the transmission unit 58*a* to be of a different configuration, considered appropriate by persons skilled in the art. The drive unit 56*a* is provided to drive the cutting strand 12*a* of the power-tool parting device 10*a* in at least one operating state, via the transmission unit 58*a*. In this case, the cutting strand 12*a*, in the guide unit 52*a* of the power-tool parting device 10*a*, is moved along a cutting direction 14*a* of the cutting strand 12*a*, in the guide unit 52*a*.

Figure 2:
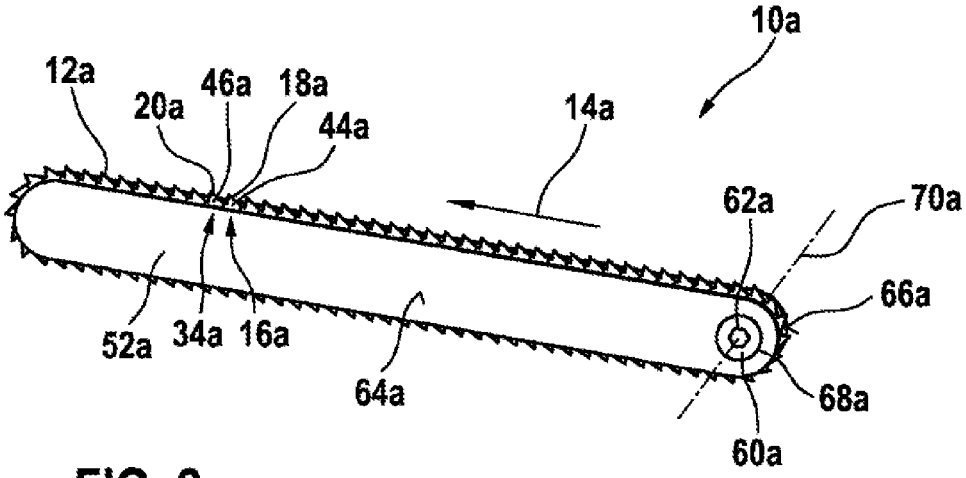
FIG. 2 shows a detail view of the power-tool parting device according to the disclosure, in a schematic representation.

FIG. 2 shows the power-tool parting device 10*a* decoupled from the coupling device 50*a* of the power tool 48*a*. The power-tool parting device 10*a* has the cutting strand 12*a* and the guide unit 52*a*, which together constitute a closed system. The cutting strand 12*a* is guided by means of the guide unit 52*a*. For this purpose, the guide unit 52*a* has at least one guide element (not represented in greater detail here), realized as a guide groove, by means of which the cutting strand 12*a* is guided. The cutting strand 12*a* in this case is guided by means of edge regions of the guide unit 52*a* that delimit the guide groove. It is also conceivable, however, for the guide element to be realized in a different manner, considered appropriate by persons skilled in the art, such as, for example, as a rib-type formation on the guide unit 52*a*, which engages in a recess on the cutting strand 12*a*. The cutting strand 12*a* comprises, in particular, a multiplicity of cutting strand segments that are connected to each other.

For the purpose of driving the cutting strand 12*a*, the power-tool parting device 10*a* or the power tool 48*a* has a torque transmission element 60*a*, which can be connected to the drive unit 56*a* and/or to the transmission unit 58*a* for the purpose of transmitting forces and/or torques to the cutting strand 12*a*. In the case of the power tool 48*a* being configured to have the torque transmission element (not represented in greater detail here), the torque transmission element is connected to the cutting strand 12*a* while the power-tool parting device 10*a* and the coupling device 50*a* are coupled. In the case of the power-tool parting device 10*a* being configured to have the torque transmission element 60*a*, the torque transmission element 60*a* and the cutting strand 12*a* are in engagement even after decoupling from the coupling device 50*a*. For the purpose of coupling the torque transmission element 60*a*, realized with the power-tool parting device 10*a*, and the drive unit 56*a* and/or the transmission unit 58*a*, the torque transmission element 60*a* has a coupling recess 62*a*, in which a pinion (not represented in greater detail here) of the drive unit 56*a* and/or a toothed wheel (not represented in greater detail here) and/or a toothed shaft (not represented in greater detail here) of the transmission unit 58*a* engages, when in an assembled state. The coupling recess 62*a* is disposed concentrically in the torque transmission element 60*a*. Moreover, the torque transmission element 60*a* is realized as a toothed wheel. The torque transmission element 60*a* is mounted, at least partially, in the guide unit 52*a*. The torque transmission element 60*a* in this case, as viewed along a direction perpendicular to the cutting plane, is disposed, at least partially, between outer faces 64*a*, 66*a* of the guide unit 52*a*, in a recess 68*a* of the guide unit 52*a*. Moreover, the torque transmission element 60*a* is mounted in the guide unit 52*a* so as to be rotatable about a rotation axis 70*a*.

Figure 3:
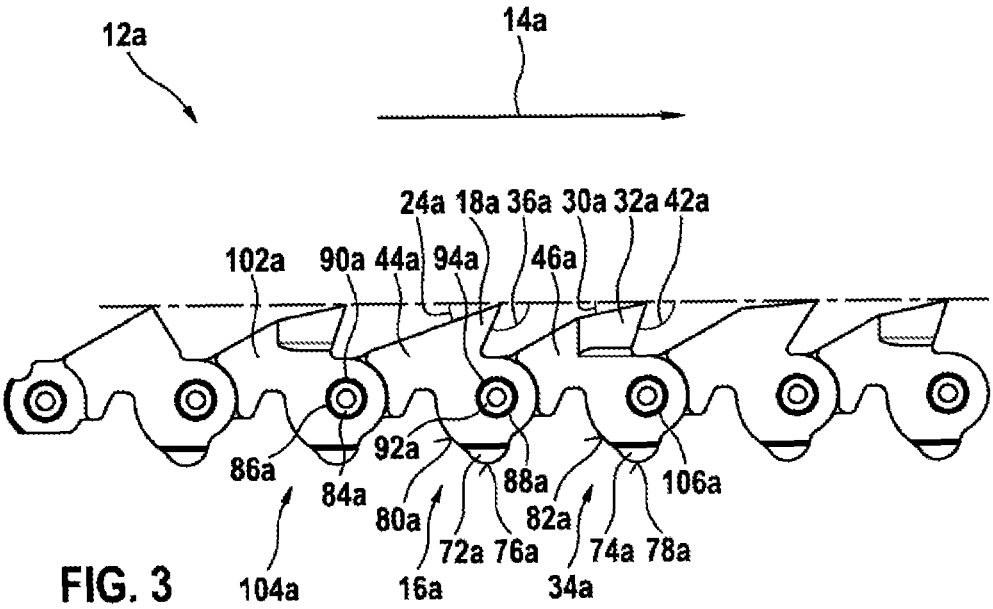
FIG. 3 shows a detail view of a cutting strand of the power-tool parting device according to the disclosure, in a schematic representation.
Figure 4:
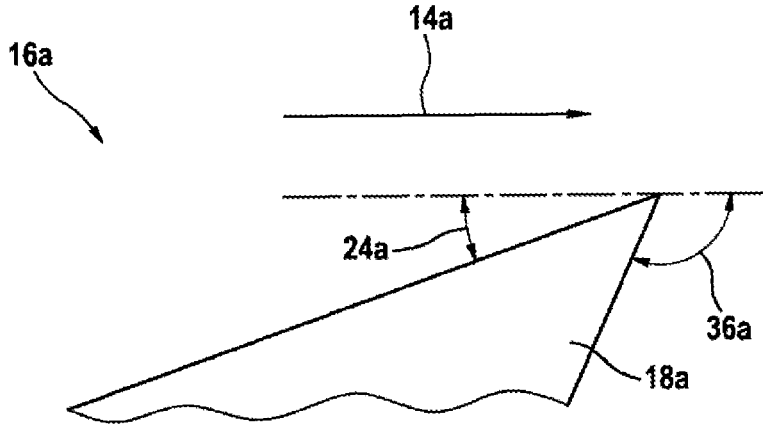
FIG. 4 shows a detail view of a cutting-edge angle geometry of a cutting element of a cutting strand segment of the cutting strand, in a schematic representation.

FIG. 3 shows a detail view of the cutting strand 12*a* of the power-tool parting device 10*a*. The cutting strand 12*a* has a cutting-edge angle geometry that varies along the cutting direction 14*a* of the cutting strand 12*a*. The cutting strand 12*a* in this case comprises at least one cutting strand segment 16*a*, comprising at least one cutting element 18*a*, which has at least one clearance angle 24*a* (FIG. 4) realized so as to differ from a clearance angle 30*a* of a cutting element 32*a* of a further cutting strand segment 34*a* of the cutting strand 12*a*. The clearance angle 24*a* of the cutting element 18*a* of the cutting strand segment 16*a* is less than 50°. In this case, the clearance angle 24*a* of the cutting element 18*a* of the cutting strand segment 16*a* has an angular dimension of between 15° and 50°. The clearance angle 30*a* of the cutting element 32*a* of the further cutting strand segment 34*a* is less than 80°. The clearance angle 30*a* of the cutting element 32*a* of the further cutting strand segment 34*a* has an angular dimension of between 20° and 80°, wherein the clearance angle 30*a* of the cutting element 32*a* of the further cutting strand segment 34*a* always differs from the clearance angle 24*a* of the cutting element 18*a* of the cutting strand segment 16*a*. Moreover, the cutting element 18*a* of the cutting strand segment 16*a* has at least one rake angle 36*a* (FIG. 4) realized so as to differ from a rake angle 42*a* of the cutting element 32*a* of the further cutting strand segment 34*a*. The cutting strand segment 16*a* additionally comprises a cutter carrier element 44*a*, which is realized so as to be integral with the cutting element 18*a* of the cutting strand segment 16*a*. The further cutting strand segment 34*a* likewise comprises a cutter carrier element 46*a*, which is realized so as to be integral with the cutting element 32*a* of the further cutting strand segment 34*a*.

The cutting strand segment 16*a* and the further cutting strand segment 34*a* each comprise at least one cutter carrier element 44*a*, 46*a*, and at least one cutting element 18*a*, 32*a* each. In this case, the cutting strand segment 16*a* and the further cutting strand segment 34*a* each have a maximum volume that is less than 15 $mm^3$. In particular, the maximum volume of the cutting strand segment 16*a* and of the further cutting strand segment 34*a* is less than 5 $mm^3$ in each case. Moreover, the cutting strand segment 16*a* and the further cutting strand segment 34*a* each have a maximum weight that is less than 1 g. In this case, a maximum weight of the cutting strand segment 16*a* and of the further cutting strand segment 34*a* is less than 0.2 g in each case.

Moreover, the cutter carrier element 44*a* of the cutting strand segment 16*a* has at least one segment guide element 72*a*, which is provided to limit a movement of the cutter carrier element 44*a* of the cutting strand segment 16*a*, when disposed in the guide unit 52*a*, as viewed in a direction away from the guide unit 52*a*, at least along the direction that is at least substantially parallel to the cutting plane. The segment guide element 72*a* is constituted by a transverse projection that extends at least substantially perpendicularly in relation to the cutting plane. The segment guide element 72*a* in this case delimits a longitudinal groove. The segment guide element 72*a* is provided to act in combination with segment guide elements (not represented in greater detail here) that are realized as a rib or perforation and disposed on the inner wall of the guide unit 52*a* that faces toward the cutter carrier element 44*a* of the cutting strand segment 16*a*, for the purpose of limiting movement. The segment guide elements are realized so as to correspond with the segment guide element 72*a*. The cutter carrier element 46*a* of the further cutting strand segment 34*a* likewise comprises a segment guide element 74*a*, which is similar in configuration to the segment guide element 72*a*.

Moreover, the cutter carrier element 44*a* of the cutting strand segment 16*a* has a compressive-force transfer face 76*a*. The compressive-force transfer face 76*a* is provided, by acting in combination with a compressive-force absorption region (not represented in greater detail here) of the guide unit 52*a*, to support compressive forces that act upon the cutting strand 12*a* as work is being performed on a workpiece (not represented in greater detail here). In this case, the compressive-force absorption region of the guide unit 52*a*, as viewed along a direction that is at least substantially perpendicular to the cutting plane of the cutting strand 12*a*, is disposed between the outer faces 64*a*, 66*a* of the guide unit 52*a* that are at least substantially parallel to each other. The cutter carrier element 46*a* of the further cutting strand segment 34*a* likewise comprises a compressive-force transfer face 78*a*, which is similar in configuration to the compressive-force transfer face 76*a*.

The cutter carrier element 44*a* of the cutting strand segment 16*a* additionally has a driving face 80*a*, which is provided to act in combination with driving faces of a torque transmission element 60*a*, for the purpose of driving the cutting strand 12*a*. The driving faces of the torque transmission element 60*a* in this case are realized as tooth flanks. In this case, the driving face 80*a* of the cutter carrier element 44*a* of the cutting strand segment 16*a* is realized so as to correspond with the driving faces of the torque transmission element 60*a*. When the cutting strand 12*a* is being driven, the tooth flanks of the torque transmission element 60*a* bear temporarily against the driving face 80*a* of the cutter carrier element 44*a* of the cutting strand segment 16*a*, for the purpose of transmitting driving forces. The cutter carrier element 46*a* of the further cutting strand segment 34*a* likewise comprises a driving face 82*a*, which is similar in configuration to the driving face 80*a*.

The cutting strand 12*a* additionally has at least one connecting element 84*a*, which is realized so as to be integral with the cutter carrier element 44*a* of the cutting strand segment 16*a*. The connecting element 84*a* is realized in the form of a stud and extends at least substantially perpendicularly in relation to the cutting plane. The connecting element 84*a* in this case is provided, by acting in combination with a connecting recess 86*a* of a cutter carrier element 102*a* of an additional cutting strand segment 104*a* of the cutting strand 12*a*, to realize a form-fitting connection between the cutter carrier element 44*a* of the cutting strand segment 16*a* and the additional cutter carrier element 102*a* of the additional cutting strand segment 104*a*. The cutter carrier element 44*a* of the cutting strand segment 16*a* and the cutter carrier element 46*a* of the further cutting strand segment 34*a* each likewise comprise a connecting recess 88*a*, 106*a*, in which a further connecting element (not represented in greater detail here) of the cutting strand 12*a* can be disposed, in order to form the cutting strand 12*a*. The cutter carrier element 46*a* of the further cutting strand segment 34*a* likewise comprises a connecting element 92*a*, which is similar in configuration to the connecting element 84*a*. Each cutter carrier element of the cutting strand 12*a* thus comprises at least one connecting element and at least one connecting recess. By means of a combined action of the connecting elements and the connecting recesses, the cutter carrier elements of the cutting strand 12*a* are mounted so as to be pivotable relative to each other. The cutting strand segment 16*a* and the further cutting strand segment 34*a* are thus similar to each other in their configuration.

In addition, the cutter carrier element 44*a* of the cutting strand segment 16*a* has at least one transverse securing element 90*a*, which is provided to secure insofar as possible the cutter carrier element 44*a* of the cutting strand segment 16*a*, when in a mounted state, against a transverse movement relative to the further cutter carrier element 46*a* of the further cutting strand segment 34*a* of the cutting strand 12*a*. The transverse securing element 90*a* of the cutter carrier element 44*a* of the cutting strand segment 16*a* is disposed on the connecting element 84*a* of the cutter carrier element 44*a* of the cutting strand segment 16*a*. It is also conceivable, however, for the transverse securing element 90*a* of the cutter carrier element 44*a* of the cutting strand segment 16*a* to be disposed at a different region of the cutter carrier element 44*a* of the cutting strand segment 16*a*, considered appropriate by persons skilled in the art, such as, for example, in a coupling region, in which the connecting element 84*a* of the cutter carrier element 44*a* of the cutting strand segment 16*a* is disposed and which, when the cutter carrier element 44*a* of the cutting strand segment 16*a* is coupled to the further cutter carrier element 46*a* of the further cutting strand segment 34*a*, contacts a lateral face of the further cutter carrier element 46*a*, at least partially. The cutter carrier element 46*a* of the further cutting strand segment 34*a* likewise comprises a transverse securing element 94*a*, which is similar in configuration to the transverse securing element 90*a*.

Figure 5:
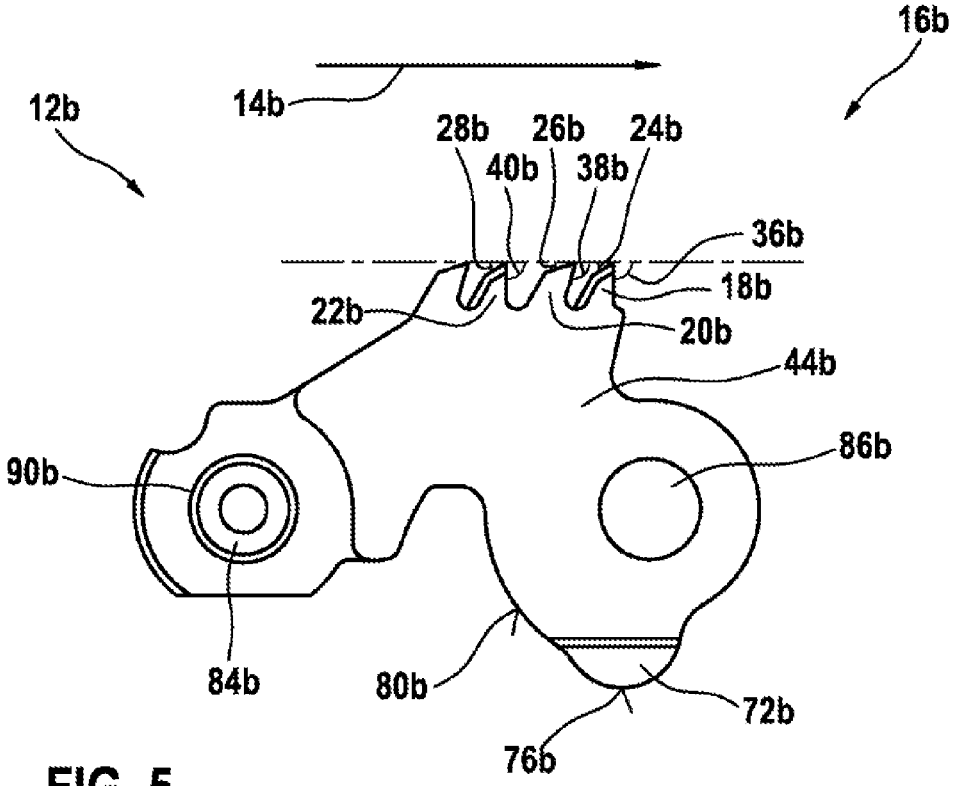
FIG. 5 shows a detail view of an alternative cutting strand segment of a cutting strand of a power-tool parting device according to the disclosure, in a schematic representation.
Figure 6:
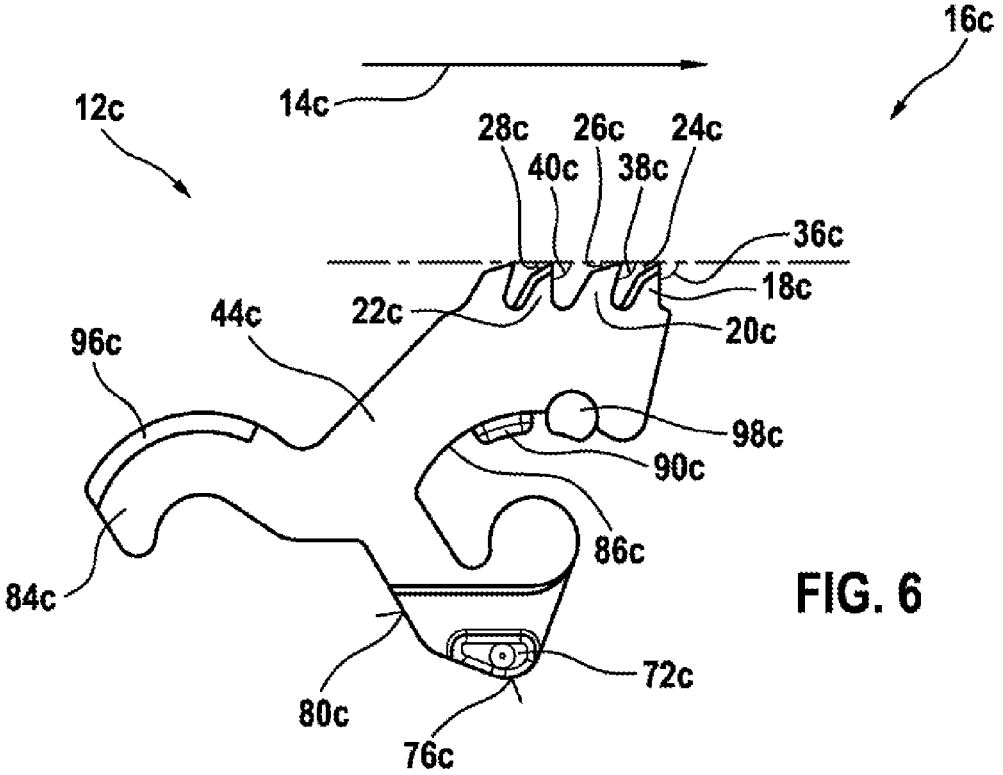
FIG. 6 shows a detail view of a further, alternative cutting strand segment of a cutting strand of a power-tool parting device according to the disclosure, in a schematic representation.
Figure 7:
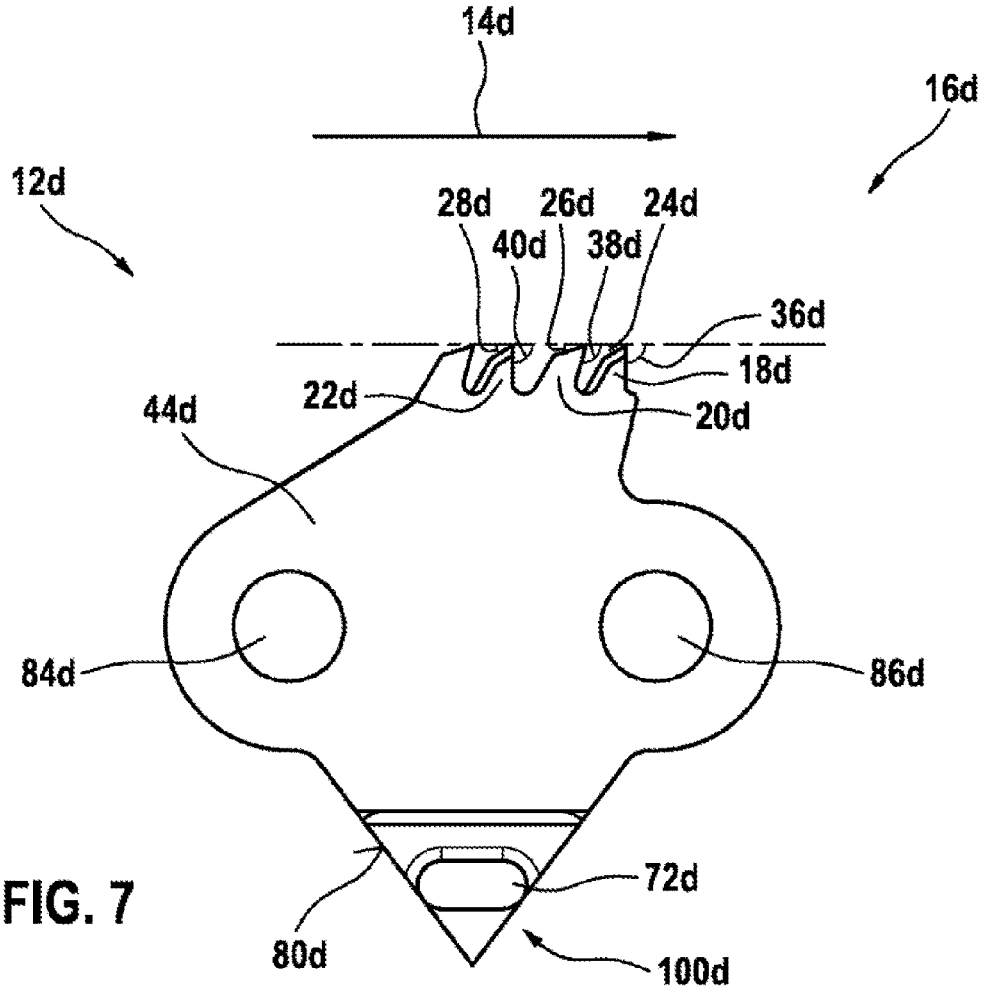
FIG. 7 shows a detail view of a further, alternative cutting strand segment of a cutting strand of a power-tool parting device according to the disclosure, in a schematic representation.

Alternative exemplary embodiments are represented in FIGS. 5 to 7. Components, features and functions that remain substantially the same are denoted basically by the same references. To differentiate the exemplary embodiments, the letters a to d have been appended to the references of the exemplary embodiments. The following description is limited substantially to the differences as compared with the first exemplary embodiment described in FIGS. 1 to 4, and reference may be made to the description of the first exemplary embodiment in FIGS. 1 to 4 in respect of components features and functions that remain the same.

FIG. 5 shows a detail view of an alternative cutting strand segment 16*b* of a cutting strand 12*b* of a power-tool parting device (not represented in greater detail here). The cutting strand 12*b* has a cutting-edge angle geometry that varies along a cutting direction 14*b* of the cutting strand 12*b*. The cutting strand segment 16*b* comprises at least one cutting element 18*b* and at least one further cutting element 20*b*, wherein the cutting element 18*b* has a clearance angle 24*b* realized so as to differ from a clearance angle 26*b* of the further cutting element 20*b*. In addition, the cutting strand segment 16*b* has at least one additional cutting element 22*b*, which has a clearance angle 28*b* that differs from the clearance angle 24*b* of the cutting element 18*b* and/or from the clearance angle 26*b* of the further cutting element 20*b*. It is also conceivable, however, for the cutting strand segment 16*b* to have a number of cutting elements other than three. Moreover, the cutting element 18*b* has a rake angle 36*b* realized so as to differ from a rake angle 38*b* of the further cutting element 20*b*. Further, the additional cutting element 22*b* has a rake angle 40*b* that differs from the rake angle 36*b* of the cutting element 18*b* and/or from the rake angle 40*b* of the further cutting element 20*b*. Further, the cutting strand segment 16*b* comprises at least one cutter carrier element 44*b*, which is realized so as to be integral with the cutting element 18*b*, the further cutting element 20*b* and the additional cutting element 22*b*. In respect of further features of the cutting strand segment 16*b*, reference may be made to the exemplary embodiment described in FIGS. 1 to 4.

FIG. 6 shows a detail view of a further alternative cutting strand segment 16*c* of a cutting strand 12*c* of a power-tool parting device (not represented in greater detail here). The cutting strand 12*c* has a cutting-edge angle geometry that varies along a cutting direction 14*c* of the cutting strand 12*c*. The cutting strand segment 16*c* comprises at least one cutting element 18*c* and at least one further cutting element 20*c*, wherein the cutting element 18*c* has a clearance angle 24*c* realized so as to differ from a clearance angle 26*c* of the further cutting element 20*c*. In addition, the cutting strand segment 16*c* has at least one additional cutting element 22*c*, which has a clearance angle 28*c* that differs from the clearance angle 24*c* of the cutting element 18*c* and/or from the clearance angle 26*c* of the further cutting element 20*c*. It is also conceivable, however, for the cutting strand segment 16*c* to have a number of cutting elements other than three. Moreover, the cutting element 18*c* has a rake angle 36*c* realized so as to differ from a rake angle 38*c* of the further cutting element 20*c*. Further, the additional cutting element 22*c* has a rake angle 40*c* that differs from the rake angle 36*c* of the cutting element 18*c* and/or from the rake angle 40*c* of the further cutting element 20*c*.

Further, the cutting strand segment 16*c* comprises at least one cutter carrier element 44*c*, which is realized so as to be integral with the cutting element 18*c*, the further cutting element 20*c* and the additional cutting element 22*c*. For the purpose of forming the cutting strand 12*c*, the cutter carrier element 44*c* comprises at least one connecting element 84*c*. The connecting element 84*c* is realized so as to be integral with the cutter carrier element 44*c*. The connecting element 84*c* in this case is realized as a longitudinal extension of the cutter carrier element 44*c*. The longitudinal extension is realized in the shape of a hook. The longitudinal extension in this case is other than a bar-shaped extension, on which there is formed a circular form-fitting element, and/or other than a semicircular extension. Furthermore, the connecting element 84*c* realized as a longitudinal extension has a transverse securing region 96*b* on one side. The transverse securing region 96*c* is provided, by acting in combination with at least one transverse securing element of a further cutter carrier element (not represented in greater detail here) of a further cutting strand segment of the cutting strand 12*c*, which further cutter carrier element is connected to the cutter carrier element 44*c*, to prevent, at least insofar as possible, a transverse movement of the cutter carrier element 44*c* along at least two opposing directions, when in a coupled state, relative to the further cutter carrier element. In this case, the transverse securing region 96*c* is realized as a rib. It is also conceivable, however, for the transverse securing region 96*c* to be of a different configuration, considered appropriate by persons skilled in the art, such as, for example, configured as a groove, etc. The transverse securing region 96*c* is disposed on a side of the connecting element 84*c* that faces toward the cutting elements 18*c*, 20*c*, 22*c* that are realized so as to be integral with the cutter carrier element 44*c*.

The cutter carrier element 44*c* additionally has two transverse securing elements 90*c*, 98*c*, which are provided, when the cutter carrier element 44*c* has been coupled to the further cutter carrier element, to act in combination with a transverse securing region of the further cutter carrier element. The transverse securing elements 90*c*, 98*c* are each disposed in an edge region of the cutter carrier element 44*c* that delimits a connecting recess 86*c* of the cutter carrier element 44*c*. The transverse securing elements 90*c*, 98*c* in this case are realized so as to be integral with the cutter carrier element 44*c*. The transverse securing elements 90*c*, 98*c* are each integrally formed on to the cutter carrier element 44*c* by means of a stamping process.

FIG. 7 shows a further alternative cutting strand segment 16*d* of a cutting strand 12*d* of a power-tool parting device (not represented in greater detail here). The cutting strand 12*d* has a cutting-edge angle geometry that varies along a cutting direction 14*d* of the cutting strand 12*d*. The cutting strand segment 16*d* comprises at least one cutting element 18*d* and at least one further cutting element 20*d*, wherein the cutting element 18*d* has a clearance angle 24*d* realized so as to differ from a clearance angle 26*d* of the further cutting element 20*d*. In addition, the cutting strand segment 16*d* has at least one additional cutting element 22*d*, which has a clearance angle 28*d* that differs from the clearance angle 24*d* of the cutting element 18*d* and/or from the clearance angle 26*d* of the further cutting element 20*d*. It is also conceivable, however, for the cutting strand segment 16*d* to have a number of cutting elements other than three. Moreover, the cutting element 18*d* has a rake angle 36*d* realized so as to differ from a rake angle 38*d* of the further cutting element 20*d*. Further, the additional cutting element 22*d* has a rake angle 40*d* that differs from the rake angle 36*d* of the cutting element 18*d* and/or from the rake angle 40*d* of the further cutting element 20*d*.

Further, the cutting strand segment 16*d* comprises at least one cutter carrier element 44*d*, which is realized so as to be integral with the cutting element 18*d*, the further cutting element 20*d* and the additional cutting element 22*d*. For the purpose of forming the cutting strand 12*d*, the cutter carrier element 44*d* comprises a connecting element 84*d*, in the form of a stud, and a connecting recess 88*d*, into which a stud-type connecting element (not represented in greater detail here) of a further cutter carrier element (not represented in greater detail here) of a further cutting strand segment of the cutting strand 12*d* can be brought. It is also conceivable, however, for the cutter carrier element 44*d* to be realized so as to be separate from the connecting element 84*d*, and to have instead two connecting recesses 88*d*, into each of which a stud-type connecting element can be inserted, for the purpose of forming the cutting strand 12*d*.

Moreover, the cutter carrier element 44*d* comprises at least one segment guide element 72*d*. The cutter carrier element 44*d* additionally comprises a driving region 100*d*, which has a triangular shape. In this case, the segment guide element 72*d* is disposed in the driving region 100*d*. Further, a driving face 80*d* of the cutter carrier element 44*d* is disposed in the driving region 100*d*.

The invention claimed is:

1. A power-tool parting device, comprising:

a cutting strand including at least two cutting strand segments rotatably coupled to each other, wherein each cutting strand segment includes at least two cutting elements, each cutting strand segment including a cutting edge configured for cutting a workpiece in a cutting plane, wherein the cutting edge has a cutting-edge angle geometry that varies along a cutting direction of the cutting strand segment, and wherein at least one of the at least two cutting elements has a different magnitude of clearance angle from others of the at least two cutting elements, the clearance angle defined in the cutting plane, wherein the at least two cutting strand segments each include a cutter carrier element, and a connecting element connects the cutter carrier element of adjacent ones of said at least two cutting strand segments, and wherein each cutter carrier element includes;

a stud integral with the cutter carrier element and extending therefrom perpendicular to the cutting plane, and a recess configured to receive the stud of a cutter carrier element of an adjacent cutting strand segment to rotatably couple adjacent ones of said at least two cutting strand segments.

2. The power-tool parting device as claimed in claim 1, wherein:

at least one of the at least two cutting elements has a different magnitude of rake angle than others of the at least two cutting elements, the rake angle defined in the cutting plane.

3. The power-tool parting device as claimed in claim 1, wherein the at least two cutting strand segments each include at least one cutter carrier element, wherein the at least one carrier element together with the at least two cutting elements have a maximum volume that is less than 15 $mm^3$.

4. The power-tool parting device as claimed in claim 1, wherein the at least two cutting strand segments each include at least one cutter carrier element, wherein the at least one carrier element together with the at least two cutting elements have a maximum weight that is less than 1 g.

5. The power-tool parting device as claimed in claim 1, wherein each cutting strand segment includes three cutting elements spaced apart in the cutting plane.

6. The power-tool parting device as claimed in claim 5, wherein two of the three cutting elements have the same magnitude of clearance angle and the third of the three cutting elements has a magnitude of clearance angle that is different from the magnitude of the clearance angle of said two of the three cutting elements.

7. The power-tool parting device as claimed in claim 6, wherein said of the three cutting elements is separated by said third of the three cutting elements.

8. The power-tool parting device as claimed in claim 6, wherein said two of the three cutting elements have the same magnitude of rake angle and said third of the three cutting elements has a magnitude of rake angle that is different from the magnitude of the rake angle of said two of the three cutting elements.

9. The power-tool parting device as claimed in claim 5, wherein two of the three cutting elements have the same magnitude of rake angle and the third of the three cutting elements has a magnitude of rake angle that is different from the magnitude of the rake angle of the two of the three cutting elements.

10. The power-tool parting device as claimed in claim 5, wherein each of the three cutting elements has a magnitude of clearance angle that is different from the magnitude of the clearance angle of the other two of the three cutting elements.

11. The power-tool parting device as claimed in claim 5, wherein each of the three cutting elements has a magnitude of rake angle that is different from the magnitude of the rake angle of the other two of the three cutting elements.

12. A power tool, comprising:

at least one coupling device configured to couple in a form-fitting and/or force-fitting manner to a power-tool parting device, wherein the power-tool parting device has at least one cutting strand, the at least one cutting strand having a cutting edge configured for cutting a workpiece in a cutting plane, the cutting edge having a cutting-edge angle geometry that varies along a cutting direction of the cutting strand, wherein the at least one cutting strand includes at least two cutting strand segments rotatably coupled to each other, each having at least two cutting elements, and wherein at least one of the at least two cutting elements of each cutting strand segment has a clearance angle having a magnitude that differs from a magnitude of a clearance angle of others of the at least two cutting elements, the clearance angle defined in the cutting plane, wherein the at least two cutting strand segments each include a cutter carrier element, and a connecting element connects the cutter carrier element of adjacent ones of said at least two cutting strand segments, and wherein each cutter carrier element includes;

a stud integral with the cutter carrier element and extending therefrom perpendicular to the cutting plane, and a recess configured to receive the stud of a cutter carrier element of an adjacent cutting strand segment to rotatably couple adjacent ones of said at least two cutting segments.

13. The power-tool parting device as claimed in claim 12, wherein said connecting element includes a transverse securing element that secures adjacent ones of said at least two cutting segments against movement relative to each other that is transverse to the cutting plane.

14. A power tool system including the power tool as claimed in claim 12.

* * * * *